US007040258B2

(12) United States Patent
Peart et al.

(10) Patent No.: US 7,040,258 B2
(45) Date of Patent: May 9, 2006

(54) LOW NOX WATER HEATER WITH SERPENTINED AIR ENTRY

(75) Inventors: Jacob A. Peart, Wetumpka, AL (US); Troy E. Trant, Letohatchee, AL (US)

(73) Assignee: Rheem Manufacturing Company, New York, NY (US)

( * ) Notice: Subject to any disclaimer, the term of this patent is extended or adjusted under 35 U.S.C. 154(b) by 0 days.

(21) Appl. No.: 10/959,518

(22) Filed: Oct. 6, 2004

(65) Prior Publication Data

US 2006/0070585 A1 Apr. 6, 2006

(51) Int. Cl.
*F24H 1/00* (2006.01)

(52) U.S. Cl. ..... 122/13.01; 122/13.3; 122/38

(58) Field of Classification Search ..... 122/17.1, 122/17.2, 13.01, 13.3, 38
See application file for complete search history.

(56) References Cited

U.S. PATENT DOCUMENTS

| | | | | | |
|---|---|---|---|---|---|
| 282,567 | A | * | 8/1883 | Richardson | 165/47 |
| 722,703 | A | * | 3/1903 | Haug et al. | 122/183 |
| 2,485,536 | A | * | 10/1949 | Pierce et al. | 122/161 |
| 3,792,688 | A | * | 2/1974 | Grainger | 122/248 |
| 4,398,502 | A | * | 8/1983 | Park | 122/17.2 |
| 4,600,410 | A | | 7/1986 | Baillie et al. | |
| 4,679,528 | A | | 7/1987 | Krans et al. | |
| 5,180,486 | A | | 1/1993 | Smolensky et al. | |
| 5,359,966 | A | * | 11/1994 | Jensen | 122/17.1 |
| 6,030,585 | A | | 2/2000 | Shiban | |
| 6,109,216 | A | * | 8/2000 | Reynolds et al. | 122/13.01 |
| 6,223,697 | B1 | | 5/2001 | Overbey, Jr. | |
| 6,412,447 | B1 | | 7/2002 | Trant et al. | |
| 6,418,884 | B1 | | 7/2002 | Rucker | |
| 6,435,140 | B1 | | 8/2002 | Joyce | |
| 6,497,200 | B1 | | 12/2002 | Stretch et al. | |
| 6,622,661 | B1 | | 9/2003 | Hotton | |
| 6,662,757 | B1 | | 12/2003 | Lesage | |
| 6,725,811 | B1 | * | 4/2004 | Moore et al. | 122/13.01 |
| 6,761,134 | B1 | | 7/2004 | Trant | |
| 2004/0069247 | A1 | | 4/2004 | Stretch et al. | |

FOREIGN PATENT DOCUMENTS

JP 08170826 7/1996

OTHER PUBLICATIONS

Mar. 30, 2005 New Zealand Examination Report.

* cited by examiner

*Primary Examiner*—Gregory Wilson
(74) *Attorney, Agent, or Firm*—Konneker & Smith, P.C.

(57) ABSTRACT

A fuel-fired low NOx water heater extending along a vertical axis has a radiant fuel burner disposed in its combustion chamber. The entire burner combustion air quantity is delivered to the burner from outside the combustion chamber via a horizontally serpentined flow path extending through an internal portion of the water heater. This serpentined air inflow path configuration causes a substantial portion of particulate matter in the incoming combustion air to be removed therefrom before entering and potentially clogging the burner.

37 Claims, 3 Drawing Sheets

LOW NOX WATER HEATER WITH SERPENTINED AIR ENTRY

BACKGROUND OF THE INVENTION

The present invention generally relates to fuel-fired heating appliances and, in illustrated embodiments thereof, more particularly provides a specially designed fuel-fired, low NOx water heater having a horizontally serpentined combustion air inlet flow path serving to remove undesirable particulate matter from the incoming combustion air before such particulate matter can be drawn into the burner portion of the water heater and potentially cause clogging thereof.

Stricter emission regulations are forcing water heater manufacturers to develop fuel-fired water heaters which are capable of producing less than 10 ng/J NOx and less than 400 ppm CO during normal operation. Fuel burners, particularly radiant gas burners, that are capable of achieving these emission limitations are susceptible to plugging by particulate matter entrained in the combustion air being supplied to the burners. A need thus exists for an improved water heater design that addresses this potential burner plugging problem. It is to this need that the present invention is primarily directed.

SUMMARY OF THE INVENTION

In carrying out principles of the present invention, in accordance with a preferred embodiment thereof, a fuel-fired heating appliance is provided which is representatively in the form of a gas-fired water heater. The water heater has a combustion chamber thermally communicatable with a fluid to be heated; a fuel burner which representatively a radiant burner and is operative to utilize received fuel and combustion air to create hot combustion products within the combustion chamber; and a wall structure defining a flow passage for flowing combustion air to the burner from outside of the combustion chamber via a preferably horizontally serpentined path configured to cause separation of particulate matter from combustion air traversing the flow passage.

Illustratively, the horizontally serpentined path extends through an interior portion of the water heater and has at least one arcuate portion extending through a substantial arc of at least ninety degrees but preferably much greater than ninety degrees so that particulate matter is centrifugally separated from the incoming combustion air. Alternatively, a non-arcuate, horizontally serpentined combustion air flow path could be utilized without departing from principles of the present invention.

In one embodiment thereof the water heater has a burner disposed within the combustion chamber and having an inlet structure projecting outwardly into an annular space circumscribing the combustion chamber. An outer jacket of the water heater has an air inlet opening into the annular space and positioned diametrically opposite from the burner inlet structure. During firing of the water heater, combustion air from outside the water heater flows inwardly through the jacket openings and then around opposite halves of the annular space to the burner inlet structure. Combustion air entering the burner inlet structure is mixed with fuel from a source thereof to form a fuel/air mixture which is combusted to form hot combustion products within the combustion chamber. The burner inlet structure extends outwardly through a combustion chamber side wall opening and through a cover member extending over the wall opening and having flame quenching/pressure relief openings extending therethrough.

In accordance with a further aspect of the present invention, the outer jacket portion of the water heater has an access opening formed therein and extending into the annular space between the jacket and the combustion chamber. A cover member is secured over the access opening, with a gasket member being interposed between the cover member and a peripheral jacket wall portion extending around the access opening. The gasket member is formed from a resilient air filtration material. Accordingly, any air drawn into the annular combustion air flow space between the jacket and the combustion chamber has undesirable particulate matter removed therefrom by the air filtering gasket member.

In another embodiment of the water heater a bottom portion of the burner projects downwardly from the combustion chamber into a plenum disposed within a skirt wall depending from a bottom peripheral portion of the combustion chamber and circumscribed by the aforementioned annular space within the water heater interior. An annular air transfer passage extends around the bottom burner portion within the skirt wall plenum, with a burner inlet structure being disposed within the air transfer passage. The jacket air inlet openings are circumferentially aligned with the burner inlet structure and air transfer openings are formed in the skirt wall diametrically opposite the jacket openings.

During firing of this embodiment of the water heater, combustion air from outside the water heater flows inwardly into the annular space between the jacket and skirt wall, flows around opposite side portions of the annular space to the skirt wall air transfer openings, into the annular air transfer passage through these transfer openings, and then around opposite side portions of the annular air transfer passage to the burner inlet structure. Combustion air entering the burner inlet structure is mixed with fuel from a source thereof to form a fuel/air mixture which is combusted to form hot combustion products within the combustion chamber.

DETAILED DESCRIPTION

Figure 1:
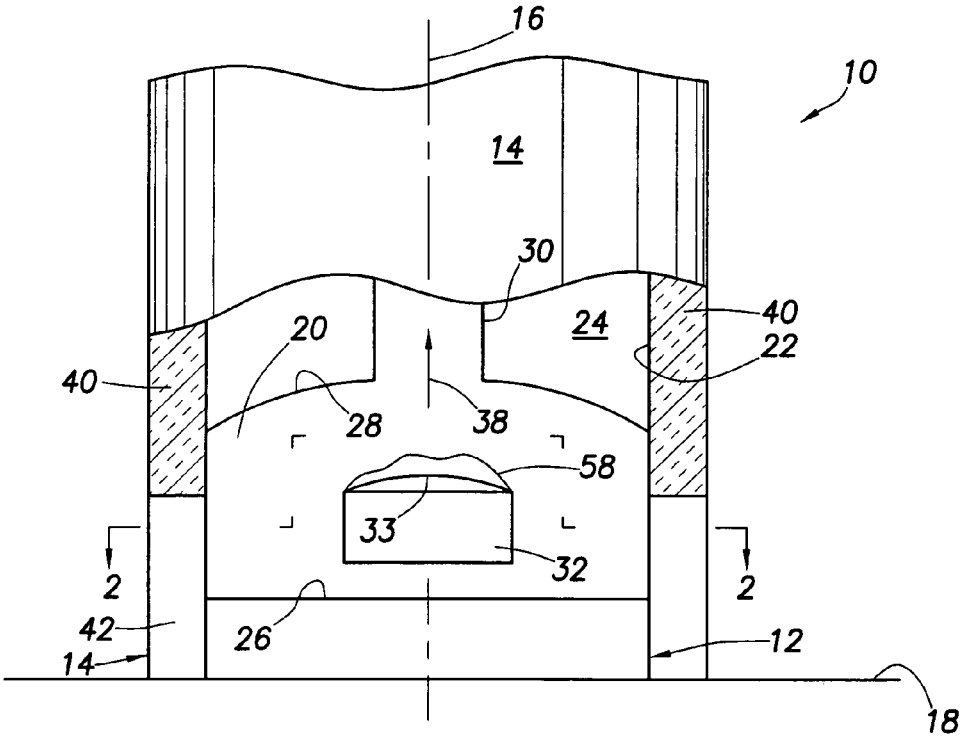
FIG. 1 is a schematic cross-sectional view through a lower end portion of a specially designed fuel-fired, low NOx water heater embodying principles of the present invention.
Figure 2:
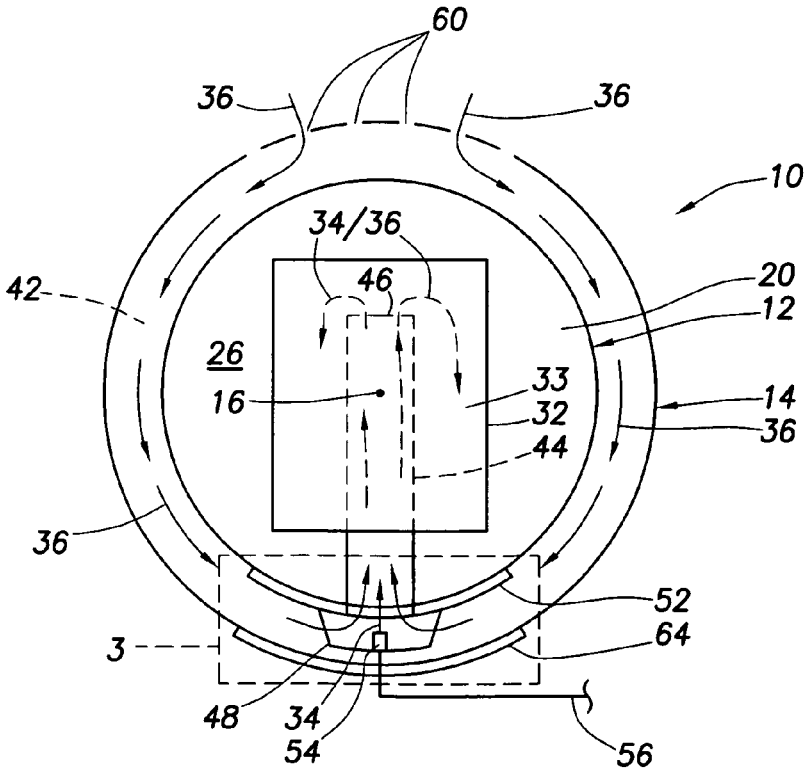
FIG. 2 is a cross-section through the water heater taken along line 2—2 of FIG. 1 and illustrating the use in the water heater of a unique combustion air intake inflow path which is horizontally serpentined to desirably remove particulate matter from the incoming combustion air before it enters the water heater burner and potentially causes clogging thereof.
Figure 3:
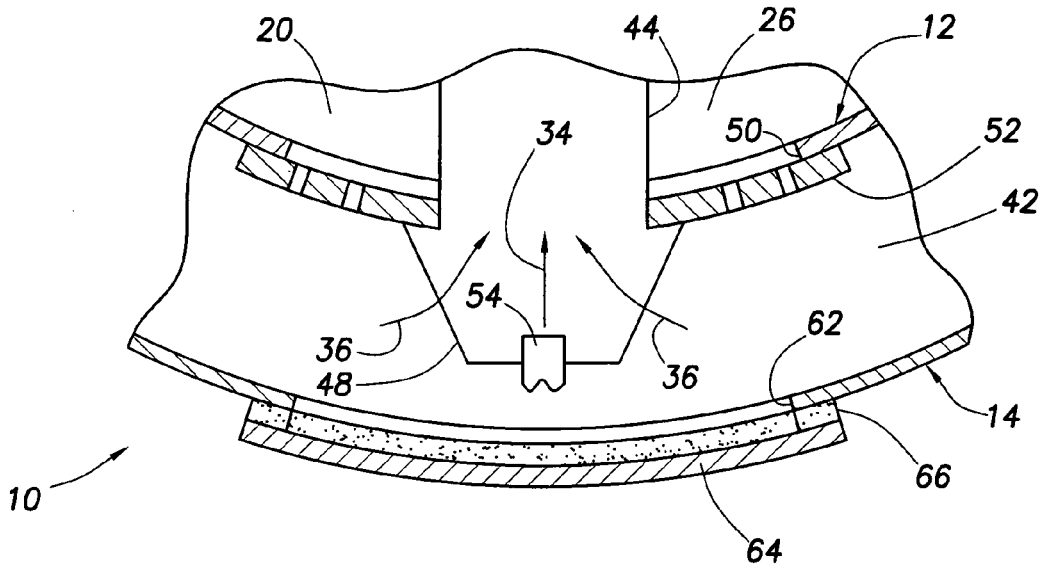
FIG. 3 is an enlarged scale detail view of the water heater portion within the dashed rectangular area "3" in FIG. 2.

Schematically depicted in FIGS. 1–3 is a fuel-fired heating appliance, representatively a gas-fired low NOx water heater 10, which embodies principles of the present invention. While principles of the present invention have been illustratively incorporated herein in a water heater, they are not limited to water heaters, and may also be advantageously incorporated in a variety of other types of fuel-fired heating appliances such as, for example but not by way of limitation, boilers and air heating furnaces.

Water heater 10 includes concentric, vertically oriented tubular inner and outer metal wall structures 12, 14 which are centered about a vertical reference axis 16 and extend upwardly from a horizontal support surface such as floor 18. The inner wall structure 12 defines a combustion chamber 20 at a lower end portion of the water heater 10, and a cylindrical tank 22 (see FIG. 1) extending upwardly from the combustion chamber 20 and adapted to hold a quantity of pressurized heated water 24 for on-demand delivery to plumbing fixtures, such as sinks, showers, dishwashers, etc., in the usual manner. The outer wall structure 14 is in the form of an outer metal jacket. Combustion chamber 20 has a bottom wall 26, and a top wall 28 which forms the bottom wall of the tank 22.

A central flue pipe 30 (see FIG. 1) communicates with the interior of the combustion chamber 20 and extends upwardly from its top wall 28 through the tank water 24. A fuel burner 32 (see FIGS. 1 and 2), representatively a gas-fired radiant burner, is disposed within the combustion chamber 20 and is operative in a subsequently described manner to receive fuel 34 from a source thereof and combustion air 36 from outside the water heater 10 (see FIGS. 2 and 3), form therefrom a fuel/air mixture 34/36, and combust the fuel/air mixture 34/36 to form hot combustion products 38 that flow upwardly through the flue 30 to heat the tank water 24. Burner 32 is of a hollow construction and has a metal mesh, flame-holding top side wall 33 (see FIGS. 1 and 2).

Insulation 40 (see FIG. 1) is disposed between the jacket 14 and the inner wall structure 12 and extends upwardly from an annular space 42 disposed at the lower end of the water heater 10, positioned between the jacket 14 and the inner wall structure 12, and horizontally circumscribing the combustion chamber 20. An inlet eductor tube 44 (see FIGS. 2 and 3) extends through the interior of the burner 32 and has an open inner outlet end 46, and an outer end inlet structure 48 disposed in the annular space 42. Tube 44 (see FIGS. 2 and 3) extends outwardly through a combustion chamber vertical side wall opening 50 (through which the burner 32 is inserted during fabrication of the water heater 10) and is suitably locked into a perforated cover plate 52 that overlies an outer wall portion of the combustion chamber 20 and covers the opening 50.

During firing of the water heater 10, fuel 34 (see FIGS. 2 and 3) is discharged into the inlet eductor tube 44 via a fuel discharge nozzle 54 mounted on the inlet structure 48 and connected to a fuel supply line 56, and combustion air 36 from outside the water heater 10 is drawn into the tube 44, via the annular space 42 and inlet structure 48, to form the fuel/air mixture 34/36 which is combusted to generate the burner flame 58 (see FIG. 1) which, in turn, creates the hot combustion products 38.

The combustion chamber 20 is substantially sealed. Accordingly, the only pathway for air (and extraneous flammable vapors potentially entrained therein) to enter the combustion chamber 20 is either through the mesh wall 33 of the burner 32 or the small perforations in the perforated cover plate 52. Both the mesh wall 33 and the perforated cover plate 52 act as flame arrestors which substantially prevent the passage of flames outwardly from the combustion chamber 20 into the annular space 42.

With primary reference now to FIG. 2, according to a key aspect of the present invention, undesirable clogging of the burner mesh 33 by particulate matter entrained in the combustion air 36 being delivered thereto during firing of the water heater 10 is substantially reduced by causing the combustion air 36 delivered to the burner 32 from the exterior of the water heater 10 to first traverse a horizontally serpentined path, representatively extending through an interior portion of the water heater 10 and centered generally about the vertical axis 16, before entering the burner 32.

In this manner, particulate matter entrained in combustion air 36 (which potentially could clog the burner) is separated out, illustratively by centrifugal force along at least one arcuate portion of the serpentined path extending through a substantial arc (the terms "substantial arc" or "substantial circumferential portion", as used herein, meaning an arc of at least but preferably much greater than about 90 degrees), before the combustion air enters the burner 32. Alternatively, the incoming combustion air 36 could be routed through a non-arcuately configured, horizontally serpentined path to separate particulate matter from the air without departing from principles of the present invention.

To effect this particulate separation in the representatively depicted water heater 10, a combustion air inlet opening area is formed in the jacket 14, representatively in the form of a spaced series of jacket perforations 60. Perforations 60 extend into the annular space 42 at a location diametrically opposite the eductor tube inlet structure 48. During firing of the water heater 10, combustion air 36 from outside the water heater 10 is drawn inwardly through the jacket perforations 60 into the annular space 42. As best illustrated in FIG. 2, approximately half of the combustion air 36 entering the annular space 42 is flowed through a right side portion of the space 42 to the eductor tube inlet structure 48 via a arc of approximately 180 degrees, while the balance of the incoming combustion air 36 is flowed through a left side portion of the space 42 to the eductor tube inlet structure 48 via a similar arc of approximately 180 degrees.

Also, as the combustion air 36 enters the annular space 42 the air is subjected to a sharp horizontal turn, and as the air 36 enters the eductor tube inlet structure 48 is subjected to another sharp horizontal turn. This horizontally serpentined path which the combustion air 36 must travel centrifugally separates undesirable particulates from the incoming combustion air to substantially reduce clogging of the illustrated burner 32.

An access opening 62 (see FIG. 3) extends through the jacket 14 and is positioned in vertical and circumferential alignment with the combustion chamber side wall opening 50. Jacket access opening 62 is exteriorly covered by a cover plate 64. According to another aspect of the present invention, sandwiched between the cover plate 64 and a peripheral jacket wall portion of the opening 62 is a gasket 66 which is formed from a suitable resilient air filtering material. In this manner, particulate matter in any air entering the annular space from around the periphery of the cover plate 64 is removed by the gasket 66 to prevent such particulate matter from entering the burner 32.

Figure 5:
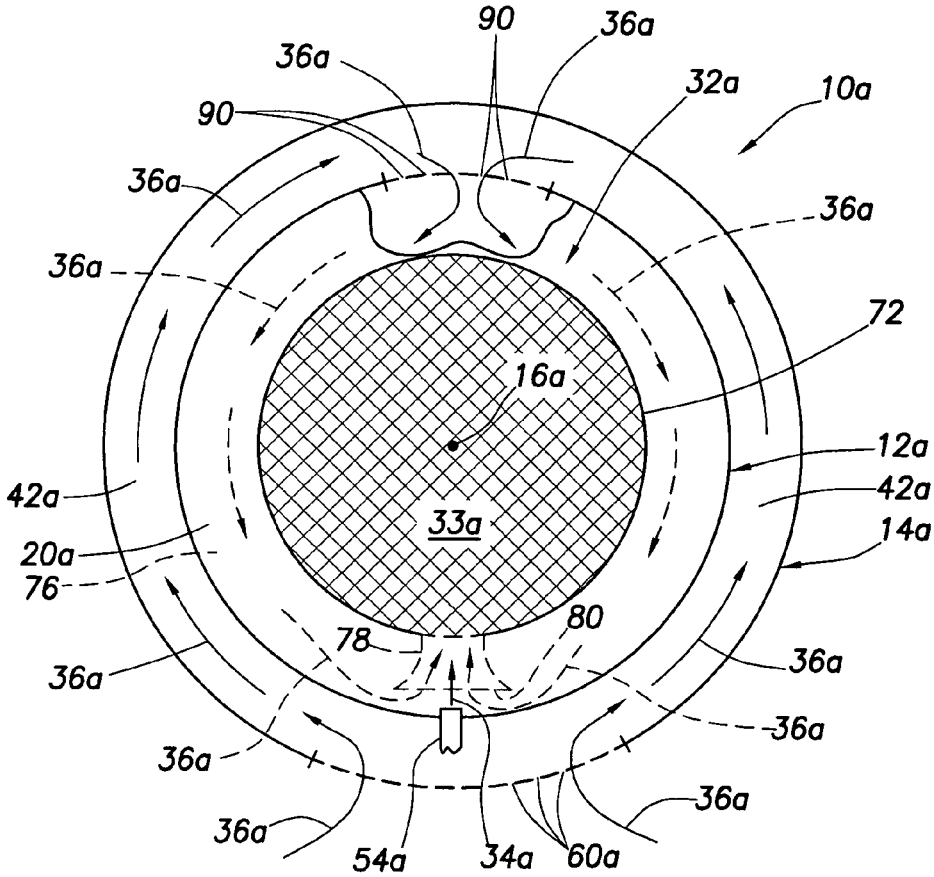
FIG. 5 is a reduced scale cross-sectional view through the FIG. 4 water heater taken along line 5—5 thereof.
Figure 4:
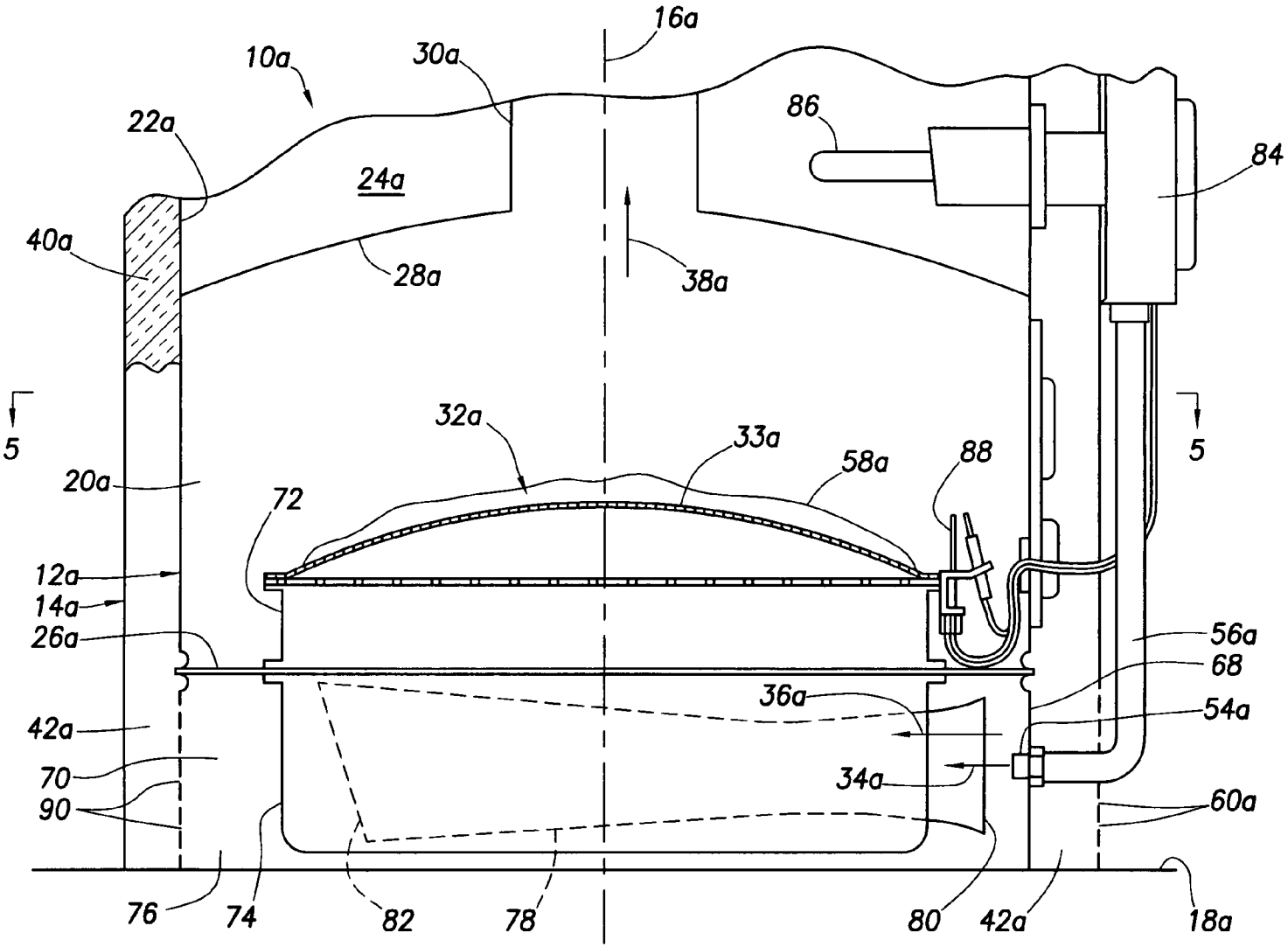
FIG. 4 is a schematic cross-sectional view through a lower end portion of an alternate embodiment of the FIG. 1 water heater.

An alternate embodiment 10*a* of the previously described water heater 10 shown in FIGS. 1–3 is schematically depicted in FIGS. 4 and 5. To facilitate comparison of the water heater embodiments 10 and 10*a*, components in the water heater 10*a* similar to those in the previously described water heater 10 have been given the same reference numerals to which the subscripts "a" have been added.

With reference now to FIGS. 4 and 5, in the water heater 10*a* an annular skirt wall 68 depends from the periphery of the bottom combustion chamber wall 26*a* and defines a plenum 70 beneath the combustion chamber 20*a*. The radiant gas burner 32*a* is representatively of a hollow cylindrical configuration with an upper portion 72 of the burner 32*a* (including the upper metal mesh side wall 33*a* of the burner) being disposed within the combustion chamber 20*a*, and a lower portion 74 of the burner 32*a* extending downwardly into the plenum 70.

An annular air transfer portion 76 of the plenum 70 circumscribes the lower burner portion 74. A venturi inlet tube 78 (see FIG. 4) horizontally extends through the lower burner portion 74 and has an open inlet end 80 disposed in the annular plenum portion 76 and an open outlet end 82 disposed within the interior of the lower burner portion 74. The open inlet end 80 of the tube 78 faces the fuel discharge nozzle 54*a* that extends inwardly through the skirt wall 68 and is attached to the fuel supply line 56*a*. In turn, the fuel supply line 56*a* is operatively connected to a thermostatic gas valve 84 mounted externally on the jacket 14*a* and having a thermostatic sensing element 86 extending through the inner wall structure 12*a* into the tank water 24*a*. Valve 84 is also operatively coupled to a suitable pilot burner structure 88 positioned adjacent the burner 32*a*.

The jacket perforations 60*a* are circumferentially aligned with the inlet end 80 of the venturi inlet tube 78. Air inlet perforations 90 are formed in the depending skirt wall 68 at a location thereon diametrically opposite from the location of the jacket inlet perforations 60*a*.

With reference now to FIG. 5, during firing of the water heater 10*a*, combustion air 36*a* from outside the water heater is caused to flow to the burner 32*a* via a horizontally serpentined path extending through an interior portion of the water heater, thereby causing particulate matter in the air 36*a*, which might clog the burner 32*a*, to be centrifugally separated out before entering the burner 32*a*. Specifically, the combustion air 36*a* is initially drawn into the annular space 42*a* through the jacket openings 60*a* and then, after making abrupt turns, flows through opposite sides of the annular space 42*a*, via first arcs of about 180 degrees each, to the skirt wall perforations 90. Upon reaching the skirt wall perforations 90, the combustion air 36*a* again makes abrupt turns and then flows through opposite sides of the annular air transfer passage portion 76 of the skirt plenum 70, via second arcs of about 180 degrees each, to the burner venturi tube inlet 80.

Upon reaching the inlet 80, the combustion air streams 36*a* turn abruptly into the inlet end 80 of the venturi tube 78, and are drawn inwardly therethrough and mixed with fuel 34*a* discharged from the nozzle 54*a* to form therewith a fuel/air mixture which is combusted to form the hot combustion products 38*a* (see FIG. 4). This tortuous path of the incoming combustion air 36*a* causes a substantial portion of particulate matter entrained in the air 36*a* to be separated therefrom before entering the burner 32*a*, thereby substantially prolonging the operational life of the burner 32*a*.

The foregoing detailed description is to be clearly understood as being given by way of illustration and example only, the spirit and scope of the present invention being limited solely by the appended claims.

What is claimed is:

1. A fuel-fired heating appliance comprising:

a combustion chamber thermally communicatable with a fluid to be heated;

a fuel burner operative to utilize received fuel and combustion air to create hot combustion products within said combustion chamber; and a wall structure defining a flow passage for flowing combustion air to said burner from outside of said combustion chamber via a horizontally serpentined path extending around a vertical axis and configured to cause separation of particulate matter from combustion air traversing said flow passage.

2. The fuel-fired heating appliance of claim 1 wherein: said fuel-fired heating appliance is a water heater.

3. The fuel-fired heating appliance of claim 2 wherein: said water heater is a gas-fired water heater.

4. The fuel-fired heating appliance of claim 1 wherein: said burner is a radiant fuel burner.

5. The fuel-fired heating appliance of claim 1 wherein: said horizontally serpentined path extends through an interior portion of said heating appliance.

6. The fuel-fired heating appliance of claim 1 wherein: at least a major portion of said horizontally serpentined path is arcuately shaped and causes a centrifugal separation of particulate matter from combustion air traversing said flow passage.

7. The fuel-fired heating appliance of claim 1 wherein: a portion of said horizontally serpentined path extends through a arc of approximately 180 degrees.

8. The fuel-fired heating appliance of claim 1 wherein: a portion of said horizontally serpentined path extends through two arcs of approximately 180 degrees each.

9. The fuel-fired heating appliance of claim 8 wherein: the combustion air flows through said two arcs are oppositely directed.

10. The fuel-fired heating appliance of claim 1 wherein: at least a portion of said burner is disposed within said combustion chamber.

11. A fuel-fired water heater comprising:

an inner wall structure defining a vertically extending tank extending upwardly from a combustion chamber;

an outer wall structure horizontally circumscribing said inner wall structure and defining therewith an annular space extending around a lower end portion of said inner wall structure;

a fuel burner operative to utilize received fuel and combustion air to create hot combustion products within said combustion chamber, said fuel burner having an air inlet communicated with said annular space; and a combustion air inlet opening area, extending inwardly through said outer wall structure, through which combustion air external to said water heater may flow into said annular space for delivery to said burner inlet via said annular space, said combustion air inlet opening area being circumferentially positioned relative to said burner air inlet in a manner causing combustion air flowing inwardly through said combustion air inlet opening area to horizontally flow through a substantial circumferential portion of said annular space before reaching said burner air inlet to thereby centrifugally remove particulate matter from combustion air being delivered to said fuel burner via said annular space.

12. The fuel-fired water heater of claim 11 wherein: said fuel burner is a gas burner.

13. The fuel-fired water heater of claim 11 wherein: said fuel burner is a radiant burner.

14. The fuel-fired water heater of claim 11 wherein: said substantial circumferential portion of said annular space extends through an arc of about 180 degrees.

15. The fuel-fired water heater of claim 11 wherein: said combustion air inlet opening area is defined by a spaced series of perforations formed in said outer wall structure.

16. The fuel-fired water heater of claim 11 wherein: at least a portion of said fuel burner is disposed within said combustion chamber.

17. The fuel-fired water heater of claim 11 wherein:

said water heater further comprises an opening formed in a wall portion of said combustion chamber, and a perforated cover member secured to said wall portion over said opening therein, the interior of said combustion chamber communicating with said annular space through said cover member, and said fuel burner is disposed within said combustion chamber and has an inlet structure extending through said cover member and defining said air inlet.

18. The fuel-fired water heater of claim 11 wherein:

said water heater further comprises an access opening formed in a portion of said outer wall structure outwardly bounding said annular space, an access cover member secured to said outer wall structure over said access opening, and a peripheral gasket structure interposed between said access cover member and a peripheral wall portion of said access opening, said peripheral gasket structure being formed from a resilient air filtration material.

19. The fuel-fired water heater of claim 11 wherein:

said annular space is a first annular space, said water heater has a second annular space circumscribed by said first annular space, and said combustion air successively flows through substantial circumferential portions of said first and second annular spaces, respectively through first and second arcs of about 180 degrees each, before reaching said burner air inlet.

20. The fuel-fired water heater of claim 19 wherein:

the air flows through said first and second arcs are oppositely directed.

21. The fuel-fired water heater of claim 11 wherein:

said water heater further comprises an annular skirt wall depending from a peripheral portion of said combustion chamber and defining a plenum outwardly circumscribed by said annular space, said skirt wall having an air transfer opening area generally diametrically opposite from said combustion air inlet opening area in said outer wall structure, said fuel burner has an upper portion disposed in said combustion chamber, and a lower portion extending downwardly through a central portion of said plenum and defining with said skirt wall an air transfer passage circumscribing said lower portion of said fuel burner, said air inlet of said burner being disposed in said air transfer passage and being generally in circumferential alignment with said combustion air inlet opening area in said outer wall structure, whereby combustion air entering said annular space through said combustion air inlet opening area sequentially flows in opposite circumferential directions through said annular space to said air transfer opening, through said air transfer opening into said air transfer passage, and then in opposite circumferential directions through said air transfer passage to said air inlet of said fuel burner for delivery therethrough to said fuel burner.

22. A fuel-fired water heater comprising:

an inner wall structure defining a vertically extending tank extending upwardly from a combustion chamber;

an outer wall structure horizontally circumscribing said inner wall structure and defining therewith an annular space extending around a lower end portion of said inner wall structure, said outer wall structure having an access opening formed therein and opening into said annular space;

a fuel burner operative to utilize fuel from a source, and combustion air delivered to said fuel burner via said annular space, to create hot combustion products within said combustion chamber, said fuel burner having an air inlet communicated with said annular space;

an access cover member secured to said outer wall structure over said access opening; and a peripheral gasket structure interposed between said access cover member and a peripheral wall portion of said access opening, said peripheral gasket structure being formed from a resilient air filtration material.

23. A method of operating a fuel-fired heating appliance having a combustion chamber with at least a portion of a fuel burner therein, said method comprising the steps of:

delivering fuel to said fuel burner;

flowing combustion air from outside said combustion chamber to said fuel burner, said flowing step including the step of causing said combustion air to traverse a horizontally serpentined flow path extending around a vertical axis and thereby separate out particulate matter from said combustion air being flowed to said fuel burner and correspondingly lessen potential particulate clogging of said fuel burner; and igniting said fuel and combustion air to create hot combustion products.

24. The method of claim 23 wherein:

said causing step is performed by causing said combustion air to traverse a horizontally serpentined, substantially arcuate path within an interior portion of said fuel-fired heating appliance in a manner centrifugally separating out particulate matter from said combustion air.

25. The method of claim 24 wherein:

said causing step is performed by causing said combustion air to traverse an arc of a least 180 degrees.

26. The method of claim 24 wherein:

said causing step is performed by causing said combustion air to traverse first and second arcs of about 180 degrees each.

27. The method of claim 26 wherein:

said causing step is performed in a manner causing said combustion air to travel in opposite directions through said first and second arcs.

28. A fuel-fired heating appliance comprising:

a combustion chamber thermally communicatable with a fluid to be heated;

a fuel burner operative to utilize received fuel and combustion air to create hot combustion products within said combustion chamber; and a wall structure defining a flow passage for flowing combustion air to said burner from outside of said combustion chamber via a path having an arcuate portion extending through a substantial arc and configured to cause centrifugal separation of particulate matter from combustion air traversing said flow passage.

29. The fuel-fired heating appliance of claim 28 wherein:

said arcuate path portion extends through an arc of at least about 180 degrees.

30. The fuel-fired heating appliance of claim 28 wherein:

said arcuate path portion is horizontally oriented.

31. The fuel-fired heating appliance of claim 28 wherein:

said flow passage is disposed within an interior portion of said heating appliance.

32. The fuel-fired heating appliance of claim 28 wherein: said heating appliance is a water heater.

33. The fuel-fired heating appliance of claim 32 wherein: said water heater is a gas-fired water heater.

34. The fuel-fired heating appliance of claim 28 wherein: said fuel burner is a radiant fuel burner.

35. The fuel-fired heating appliance of claim 28 wherein: said path is horizontally serpentined.

36. The fuel-fired heating appliance of claim 28 wherein: said arcuate path portion extends through first and second arcs of about 180 degrees each.

37. The fuel-fired heating appliance of claim 36 wherein: the combustion air flows through said first and second arcs are oppositely directed.

* * * * *